US005355685A

United States Patent [19]

Stie et al.

[11] Patent Number: 5,355,685

[45] Date of Patent: Oct. 18, 1994

[54] PURIFICATION OF REFRIGERANT

[75] Inventors: Kenneth E. Stie; Carl Calame, both of Bartlesville, Okla.

[73] Assignee: Phillips Petroleum Company, Bartlesville, Okla.

[21] Appl. No.: 31,519

[22] Filed: Mar. 15, 1993

[51] Int. Cl.[5] ..... F25B 47/00

[52] U.S. Cl. ..... 62/85; 62/195; 62/475

[58] Field of Search ..... 62/85, 195, 475, 22; 236/78 D

[56] References Cited

U.S. PATENT DOCUMENTS

| | | | |
|---|---|---|---|
| 2,929,458 | 1/1960 | Watkins | 62/195 |
| 3,274,102 | 9/1966 | Brazell et al. | 208/341 |
| 4,344,142 | 8/1982 | Diehr et al. | 364/473 |
| 4,484,453 | 11/1984 | Neiss | 62/195 |
| 4,531,375 | 7/1985 | Zinsmeyer | 62/85 |
| 5,044,166 | 9/1991 | Wijmans et al. | 62/85 |
| 5,189,889 | 3/1993 | Daily | 62/475 |

OTHER PUBLICATIONS

Mini- and Microcomputer Control in Industrial Processes, Skrokov, 1980, pp. 82–83.

Modern Dictionary of Electronics, Graf, 1972, p. 139.

*Primary Examiner*—John M. Sollecito

*Attorney, Agent, or Firm*—George E. Bogatie

[57] ABSTRACT

The presence of an undesirable quantity of noncondensible gases in a refrigeration unit is inferred as a function of both the vapor pressure and temperature at a selected point in the refrigeration unit where the noncondensible gases tend to gather. Purging of these noncondensible gases, which contaminate the refrigerant, is responsive to a comparison in a programmable controller of the actual vapor pressure measured at the selected point, and the known pressure of uncontaminated refrigerant at the temperature existing at the selected point. On detecting a difference between these pressures that is greater than a desired value, the controller calculates a control output signal needed to purge a volume of contaminated vapor from the unit that is effective for reducing the difference between the measured pressure of contaminated refrigerant and the known pressure of uncontaminated refrigerant to a desired value.

16 Claims, 3 Drawing Sheets

PURIFICATION OF REFRIGERANT

This invention relates to refrigeration. In one aspect it relates to method and apparatus for eliminating noncondensible gases in a refrigeration unit. In another aspect it relates to automatic and accurate control of a purging system for noncondensible gases in a refrigeration unit.

BACKGROUND OF THE INVENTION

It is common practice to use a flammable material such as propane as the refrigerant in closed loop refrigeration units for industrial plants where the existing hazard is not heightened by such use. Substantially pure propane, which is desired for such use because of the adverse effects of contaminants on the efficiency of the closed loop system, is for many plants prohibitively expensive. Lacking pure propane as a refrigerant, various noncondensible gases such as air and lighter hydrocarbon gases are mixed with the refrigerant used in the refrigeration unit. Although these impurities may traverse the refrigeration circuit they generally tend to collect at the top of the accumulator. The presence of noncondensible gases in a refrigeration unit reduces the efficiency of the refrigeration since, for example, their presence necessitates higher condenser pressures with accompanying increases in power costs, or the the amount of cooling fluid used to condense the refrigerant. The capacity of the refrigeration unit is also reduced since the noncondensible gases displace refrigerant vapor flowing through the refrigeration unit.

To overcome the foregoing described problems purging devices of various types have been used to remove or purge noncondensible gases from the refrigeration system. Such purging normally includes a purge chamber for collecting the noncondensible gases, and devices for automatically expelling them from the refrigeration system. The gases which collect in the purge chamber will generally include some refrigerant vapor. Usually a cooling coil is located within the the purge chamber and is supplied with a cooling fluid such as water or refrigerant. This cooling coil operates as a condensing coil to condense the refrigerant in the purge chamber which is then recirculated from the purge chamber to the refrigeration unit.

In purge systems of the type described above, if the purge operates excessively then undesirably high amounts of refrigerant may be unnecessarily expelled from the refrigeration unit.

Accordingly, it is an object of this invention to improve the operation of automatic purge systems used to remove noncondensible gases from a refrigeration unit.

Another object of this invention is to improve the efficiency of a refrigeration unit employing an impure refrigerant.

Yet another object of this invention is to effectively achieve purification of the refrigerant used in a closed loop refrigeration unit.

SUMMARY OF THE INVENTION

In accordance with this invention, the presence of an undesirable quantity of noncondensible gases in a refrigeration unit is inferred as a function of both temperature and pressure in the unit by comparing, in a programmable controller, the actual vapor pressure at a selected location in the unit where noncondensible gases tend to gather, to the known vapor pressure of uncontaminated refrigerant at the temperature actually existing in the selected location. On detecting the presence of the noncondensible gases the programmable controller calculates and sends a control output signal to a valve which controls purging of gases from the refrigeration unit.

In a preferred embodiment of the present invention, data describing pressure vs. temperature curves for uncontaminated propane is stored in the memory of the programmable controller. This stored data is used in conjunction with on-line measurements for temperature and vapor pressure for operating a purge valve for the refrigeration unit. The programmable controller essentially continuously compares the measured pressure of the contaminated refrigerant and the pressure of the uncontaminated refrigerant stored in the controllers memory. On detecting a difference between the pressure of the contaminated and uncontaminated refrigerant that is greater than a desired value, the programmable controller calculates a control output signal needed to purge a volume of contaminated vapor from the accumulator that is effective for reducing the difference between the measured pressure of contaminated refrigerant and prestored pressure data to a desired value.

Other objects and advantages of the invention will be apparent to those skilled in the art from the following description of the preferred embodiment and the appended claims and the drawings in which:

DESCRIPTION OF THE PREFERRED EMBODIMENT

While the present invention is applicable to purge systems for refrigeration units employing a variety of fluids that can serve as refrigerants such as propane, freon-22, ammonia, freon-12, methyl chloride, etc., the following description will be confined to the use of propane as the refrigerant.

Figure 1:
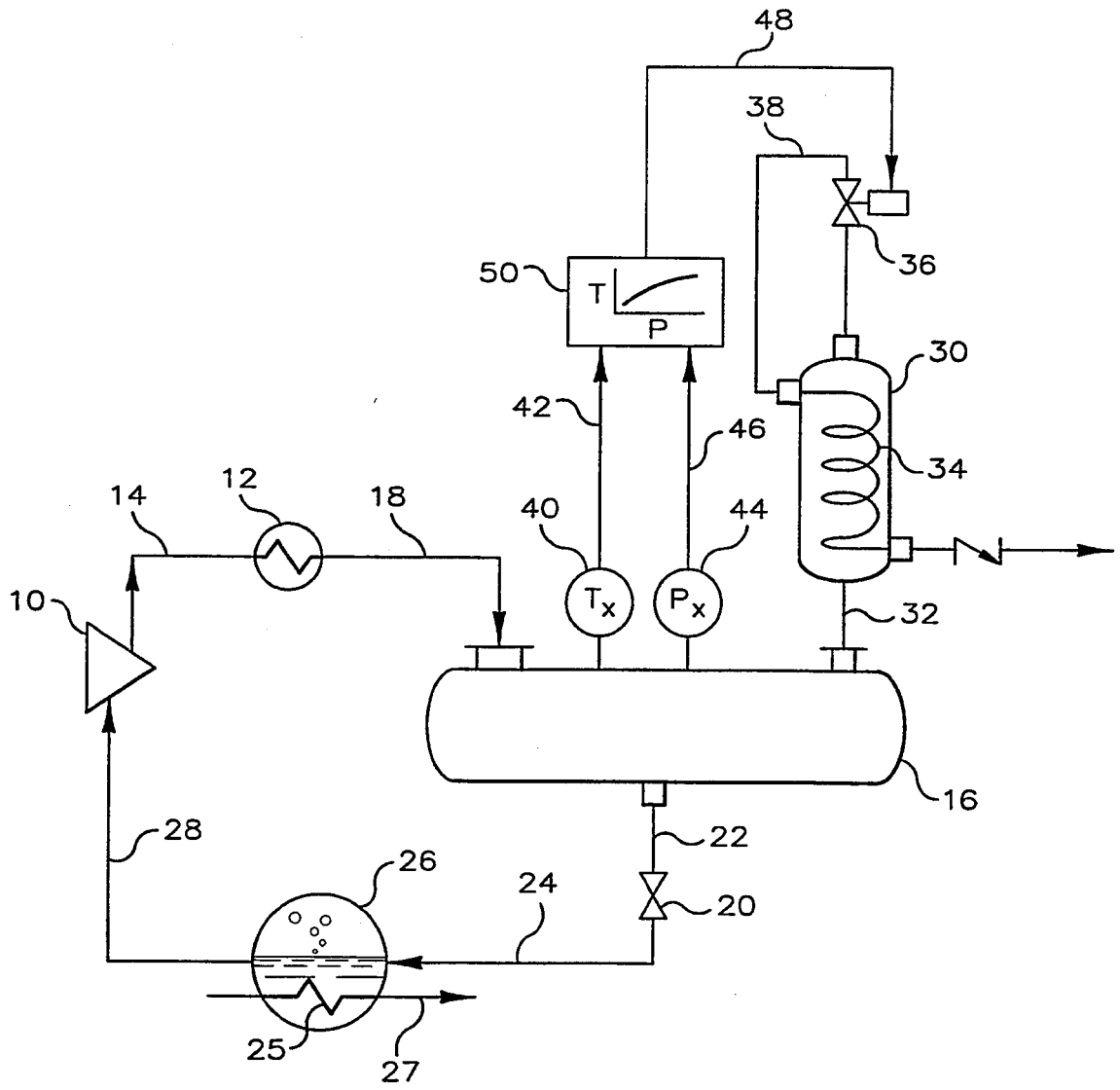
FIG. 1 is a schematic illustration of a small industrial refrigeration unit with a purge system which may be operated according to this invention.

Referring now to FIG. 1, there is a schematic illustration of a small industrial refrigeration unit with a purge system that may be operated according to the present invention. It will be recognized by those skilled in the art that since FIG. 1 is schematic only many items of equipment that would be needed in a commercial plant for successful operation have been omitted for the sake of clarity. Such items of equipment might include, for example, compressor controls, flow and level measurements and corresponding controllers, additional temperature and pressure controls, pumps, motors, filters, additional heat exchangers, and valves, etc., and all of these items would be provided in accordance with standard engineering practice.

Referring still to FIG. 1, there is illustrated a typical vapor compression refrigeration unit wherein refrigerant is compressed by a compressor 10 and discharged into a condenser 12 via conduit 14. The condenser 12 discharges liquid refrigerant to an accumulator 16 via conduit 18. From accumulator 16 liquid refrigerant is discharged to a control valve 20 via conduit 22, which supplies refrigerant through conduit 24 to evaporator 26 of the refrigeration unit. Liquid refrigerant in the evaporator 26 is vaporized by the heat of a process fluid such as a hydrocarbon feed stream in a natural gas processing plant flowing through heat transfer conduits 25 in evaporator 26. A cooled hydrocarbon stream exits the evaporator via conduit 27. Evaporated refrigerant from the evaporator 26 is discharged through conduit 28 to the suction side of compressor 10 where the refrigerant begins another refrigeration cycle.

Various noncondensible gases, which may be present in the propane charged to the refrigeration unit or otherwise enter the system through leaks, normally will accumulate in the upper portion of the accumulator 16. To purge the system without loosing an excessive amount of refrigerant, it is necessary to separate the noncondensible gases from the refrigerant. A purge chamber 30 is provided for this purpose. Time chamber 30 is connected to the accumulator 16 by a conduit 32 for extracting a gaseous mixture from the accumulator 16 and conveying it to the purge chamber 30. This gaseous mixture entering the purge chamber 30 will normally be a mixture of noncondensible gases primarily including air and methane, refrigerant vapor and possibly water vapor.

A condensing coil 34 is located in the purge chamber 30. Fluid being discharged from the purge chamber 30 is expanded across control valve 36 located in conduit 38 so as to condense the refrigerate vapor which is contained to the purge chamber 30. Alternately, the condensing coil 34 may receive cool fluid from any of a variety of sources to condense the refrigerant vapor in the purge chamber 30 such as from an external water supply, or from a separate refrigeration unit.

The refrigeration unit described to this point in the description of the preferred embodiment is conventional. It is the purge control applied to the refrigeration unit that provides the novel feature of this invention.

According to this invention, the presence of noncondensible gases in the refrigeration unit is inferred from vapor pressure and temperature measurements from the accumulator. Signals representative of the vapor pressure and temperature of the accumulator are input from measuring devices into a programmable controller which computes the control outputs needed to purge an effective amount of gases from the accumulator.

Referring still to FIG. 1, temperature transducer 40, in combination with a sensing device such as a resistance thermometry device (RTD) operably located in accumulator 16, establishes an output signal 42 which is representative of the actual temperature in accumulator 16. Signal 42 is provided as a process variable input to programmable controller 50.

Pressure transducer 44 which is operably located in accumulator 16, provides an output signal 46 which is representative of the actual vapor pressure in accumulator 16. Signal 46 is provided as a process variable signal to programmable controller 50.

In response to signals 42 and 46, the programmable controller 50 establishes an output signal 48, which is a function of both the temperature and vapor pressure in the accumulator 16 as will be more fully explained hereinafter. Signal 48 is provided to control valve 36, and control valve 36 is manipulated in response thereto.

Signal 48 is scaled so as to be representative of the position of control valve 36 required to eliminate a sufficient volume of noncondensible gases from the accumulator 16 so that the difference between the actual pressure in accumulator 16 and the pressure of uncontaminated propane at the actual temperature existing in the accumulator is less than some desired value.

A specific control system configuration is set forth in FIG. 1 for the sake of illustration. However, the invention extends to different types of control system configurations which accomplish the purpose of the invention. Lines designated as signal lines in the drawing can be electrical or pneumatic in this preferred embodiment.

This invention is also applicable to mechanical, hydraulic or other signal means for transmitting information. In almost all control systems some combination of electrical, mechanical or hydraulic signals will be used. However, use of any other type of signal transmission compatible with the process and equipment in use is within the scope of this invention.

The scaling of an output signal by a controller is well known in control system art. Essentially the output of a controller may be scaled to represent any given range of values by multiplication, division, addition or subtraction. An example would be converting a measurement of pressure at a variable temperature to specify pressure at a reference temperature. The first step is to model the process from known data, i.e. to determine how pressure varies with temperature. Then the controller must be scaled so that no compensation is applied at the reference temperature. In the case of addition or subtraction the compensating term is zero at the reference conditions, and when multiplying or dividing is required, the compensating term is 1 at reference conditions. If the controller output can range from zero to ten volts, then the output signal could be scaled so that an output signal having a voltage level of five volts corresponds to fifty percent, some specific pressure or some specific temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order that they accommodate the signal format requirements of the particular installation, safety factors, the physical characteristics of the measuring of control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Figure 2:
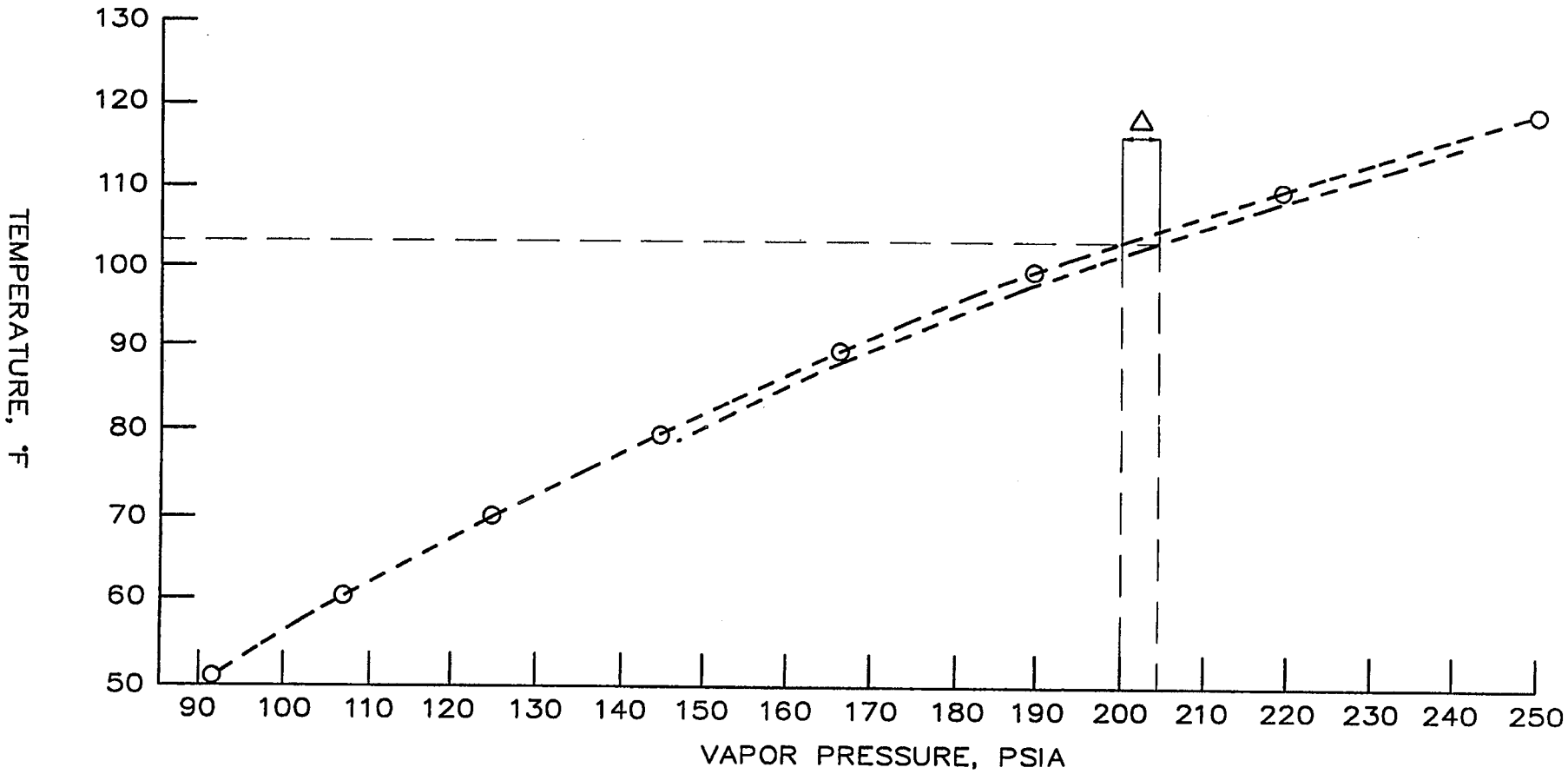
FIG. 2 is a vapor pressure vs. temperature curve for pure propane for use in accordance with a preferred embodiment this invention.

In FIG. 2 there is illustrated the temperature/pressure characteristics of uncontaminated propane, and this data is prestored in the programmable controller 50 for use in the present invention. As used herein a programmable controller is a digitally operating electronic apparatus which operates in a real time environment and uses a programmable memory for storing data, as well as storing internal instructions for implementing specific functions such as arithmetic, logic, timing, sequencing, comparing, proportional-integral control, etc., and controls various types of machines or processes through analog or digital input/output modules.

Any programmable controller having software that accommodates piecewise linerization of specific data points is suitable for use in this invention. A satisfactory programmable controller is a Taylor MOD30 TM type 1701R controller XL.

For controlling the purging system in the present invention, it is only necessary to provide the computer with the necessary data as exemplified by the plotted data points in FIG. 2, and to program the computer with a routine for manipulating control valve 36. FIG. 2 shows a temperature range of from about 50 to 130 degrees F for uncontaminated propane, it is noted, however, that this range can be extended to other ranges which might be desired for various other refrigerants.

Figure 3:
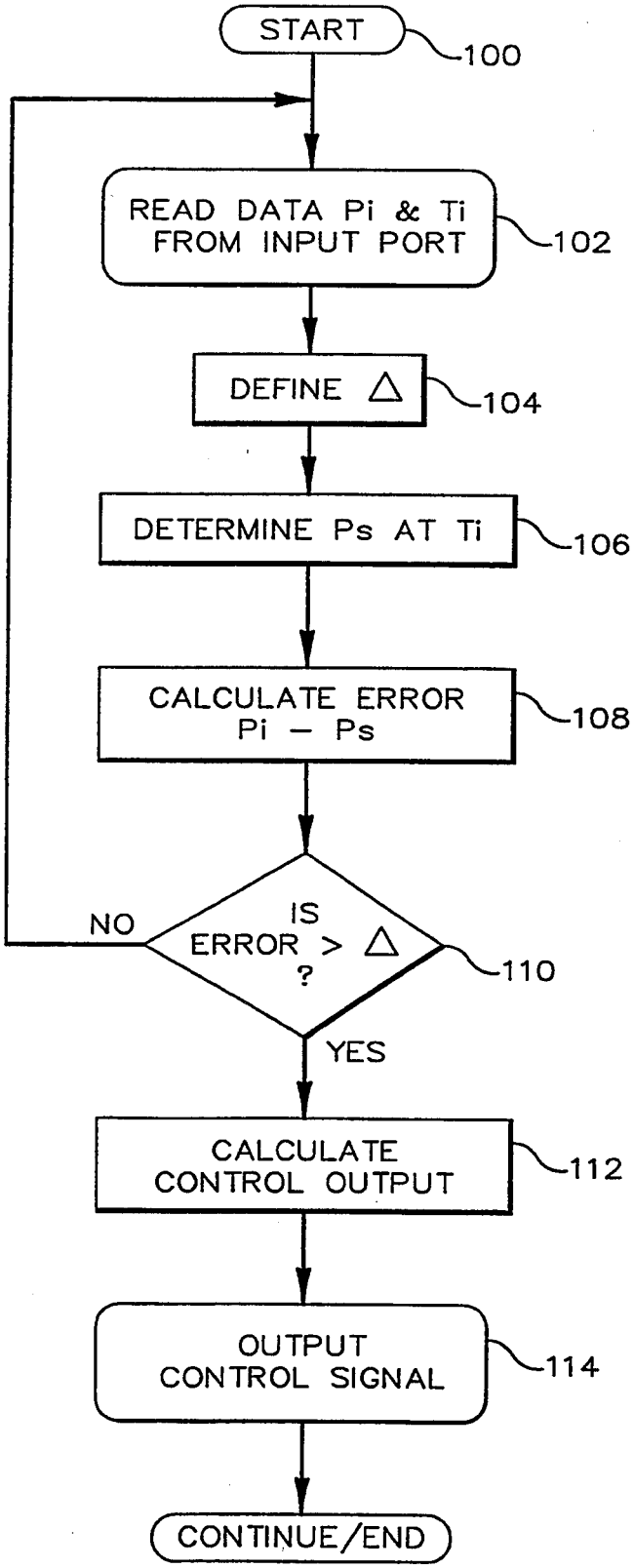
FIG. 3 is a simplified computer flow diagram for controlling the purge system according to this invention.

Referring now to FIG. 3, a flowsheet of a computer routine which defines a sequence of operations for determining the presence of noncondensible gases in a refrigeration unit, and then computing a control signal is illustrated.

The program is rendered operative at a start step 100 and reads in the required input data in step 102 which includes the actual accumulator pressure $P_i$ represented by signal 46 and the actual accumulator temperature $T_i$ represented by signal 42.

Then the program proceeds to step 104 to define an allowable differential gap called delta (Δ) between the actual pressure $P_i$ and the pressure of uncontaminated propane $P_s$ for the temperature currently existing in the accumulator. This gap is illustrated in FIG. 2. The value selected for delta will be generally be based on operator experience, since too small a value will result in excessive purging, and too large a value will adversely affect efficiency of the refrigeration unit. A typical value which was used in an actual commercial refrigeration unit is 5 psi.

In step 106 a value for the pressure of pure propane at the current temperature in tile accumulator is determined from the stored data corresponding to FIG. 2. Next the program calculates a value for an error between $P_i$ and $P_s$ in step 108. If noncondensible gases are present in the accumulator it will operate at a higher pressure than would be predicted by the pressure temperature curve for the uncontaminated propane.

In discrimination step 110 the program determines if the error s greater than the differential gap delta, and if so a PID control signal is calculated in step 112 based on the error calculated in step 108. Most programmable controllers incorporate software for special data handling features such as PID loops by using a call statement without programming the entire exercise. All that is required is supplying desired constants to the programmable controller for use in a PID control law equation as follows:

$$S=K_1E+K_2\int Edt+K_3(dE/dt)$$

where:

S=control output signal,

E=error, $K_1$=proportional tuning constant, $K_2$=integral tuning constant, and $K_3$=derivative tuning constant.

The control signal S is provided to an output module in step 114 which sends the control output to the valve 36.

The following example is provided to illustrate the decline of refrigerant lost in a refrigeration unit where the purge system is controlled as a function of both temperature and pressure according to this invention compared to a unit where the purge system is controlled in response to a singe variable of pressure, or where, as in the most typical case, the purge is performed manually.

Assuming the control point to be around "Δ" as shown in FIG. 1, the pressure will vary from 200 to 205 psig. A controller span could reasonably be expected to be from 150 to 250 psig. The proportional band would, therefore, be:

$$P.B. = \frac{200-205}{250-150} = \frac{5}{100} = 5\%$$

Without digital control based on both temperature and pressure, accuracy and precision of venting will degrade. Optimistically, no better than 20% proportional band can be maintained in venting with a conventional pressure controller. Operating around a set point of 200 psig will, therefore, result in an expected band of 20%:

$$P.B. = \frac{212.5-192.5}{250-150} = 20\%$$

$$\Delta = 20 \text{ psig}$$

In the first case, the control point will be maintained within the 5% proportional band, say at 202.5 psig. In the second case, the 20% proportional band will cause pressure excursions of 10 psig on either side of the 202.5 control point. In effect, the purge valve will be wide open (maximum controller output) at 212.5 psig, and closed at 192.5 psig (minimum controller output). While the controller will be venting noncondensibles, as well as propane in the region above 200 psig, only propane will be vented in the region below 200 psig, for in this region of pressure and temperature (200 psig, 102° F.) no noncondensible exist (FIG. 1). Therefore, in the first case, the purge valve will begin to open at 200 psig (102° F.) and be fully open at 205 psig (102° F.). In the second case, the valve will begin to open at 192.5 psig and will be fully open at 212.5 psig. In the first case, a setpoint of 200 psig will result in zero output to the valve (and no venting) unless noncondensibles are present so that pressure builds up in the system. In the second case, a setpoint of 200 psig will result in an output of 37.5%. This translates to a valve opening of 37.5% for a valve with linear characteristics. In other words, holding the system pressure at 202.5 psig with a conventional proportional-only controller will require a controller output of 37.5% and a throttling valve until the pressure declines to the setpoint or lower.

Assuming a small valve requirement and equal percentage trim, an estimate of the venting rates for a 1" valve can be made.

$$Q = \sqrt{520/GT}\ (C_g)(P_1)\mathrm{Sin}[(3417/C_1)\sqrt{\Delta P/P}]$$

where:

Q=Gas flow rate, SCFHR;

G=Specific gravity=1.5 for propane;

T=103° F.=563° R.;

$C_g$=26=Gas sizing coefficient from valve manufacturer's catalog;

$P_1$=202.5 psig;

$C_1=C_g/C_v=32$;

Δ=202.5−75 psig=127.5 psig (assumes venting to a low pressure system).

$$Q = \sqrt{520/1.5 \times 563}\ (26)(202.5)\mathrm{Sin}[(3417/32)\sqrt{127.5/202.9}]$$

Q=4122 SCFHR

This venting rate could easily result in the loss of 5% of the system charge in one hour, and would lower the system pressure to about 192 psig. The purge valve would be closed at this pressure. This rate obviously cannot be tolerated and the historical solution has been to manually vent vapor. Should a conventional pressure-purge system be used, the system would of necessity require a higher controller setpoint, resulting in higher system pressure and retention of more noncondensible gases.

Specific control components used in the practice of this invention as illustrated in FIG. 1 such as temperature transducer 40, pressure transducer 44, control valve 36 and the programmable controller 50 are each well known commercially available control components such as are described in length in Perry's Chemical Engineering Handbook, 6th Ed., Chapter 22, McGraw-Hill.

While the invention has been described in terms of the presently preferred embodiment, reasonable variations and modifications are possible by those skilled in the art and such variations and modifications are within the scope of the described invention.

That which is claimed is:

1. A method of operating a purge system for a closed loop refrigeration unit with the aid of a programmable controller, wherein said refrigeration unit employs a refrigerant which is contaminated by noncondensable gases, said method comprising:

(a) storing data in said programmable controller representative of the vapor pressure versus temperature characteristics of said refrigerant in an uncontaminated state;

(b) essentially continuously determining the actual temperature and the actual vapor pressure of said contaminated refrigerant at a location in said closed loop refrigeration unit where said noncondensable gases tend to gather, (c) essentially continuously comparing in said programmable controller the actual vapor pressure and actual temperature of said contaminated refrigerant determined in step (b) and the data stored in step (a);

(d) calculating a control output signal in said programmable controller needed to purge a volume of said contaminated refrigerant that is effective for reducing the difference between the actual vapor pressure of said contaminated refrigerant and said stored pressure data at a corresponding temperature to a desired value;

(e) automatically purging said refrigerant contaminated by noncondensable gases from said refrigeration unit responsive to said control signal when the comparison of step (c) indicates that the actual vapor pressure exceeds the vapor pressure of uncontaminated refrigerant at the corresponding temperature by a predetermined amount.

2. A method in accordance with claim 1 wherein said refrigerant is selected from a group of refrigerants including propane, freon-22, ammonia, freon-12 and methylchloride.

3. A method ill accordance with claim 2 wherein said noncondensible gases comprise air and methane.

4. A method in accordance with claim 1 wherein said noncondensible gases gather in the accumulator of said closed loop refrigeration unit.

5. A method in accordance with claim 4 wherein said step (c) of continuously comparing comprises:

establishing a first signal $P_i$ representative of the actual vapor pressure in said accumulator;

establishing a second signal representative of the actual temperature in said accumulator;

determining the value of the pressure stored in said programmable controller $P_s$ that corresponds to the temperature of said second signal;

establishing a third signal representative of the difference between $P_i$ and $P_s$.

6. A method in accordance with claim 5 wherein a control valve is provided for said purging system and wherein said step (e) for automatically purging comprises:

establishing said control output signal responsive to said third signal; and providing said control signal to said control valve for said purging system.

7. A method of operating a purge system for a closed loop refrigeration unit with the aid of a programmable controller wherein purging of said contaminated refrigerant is responsive to a control valve, and said programmable controller is provided with data representative of vapor pressure versus temperature of said refrigerant in an uncontaminated state, and a routine for manipulating said control valve, said routine comprising the following steps:

reading in a value for actual vapor pressure $P_i$ and actual temperature in said accumulator;

defining a minimum acceptable deviation for the pressure $P_i$ and a pressure $P_s$ of uncontaminated refrigerant;

determining the pressure $P_s$ of uncontaminated refrigerant corresponding to the temperature in said accumulator from the data provided to said programmable controller;

calculating an error $P_i$–$P_s$;

determining when said error is greater than said minimum acceptable deviation;

calculating a control output signal according to a proportional-interval-derivative (PID) control law for reducing said error; and outputting said control signal so as to manipulate said control valve.

8. A method of programming a programmable controller for manipulating a control valve on a refrigeration unit having an accumulator and employing a refrigerant contaminated by noncondensible gases, and having a purge system using said control valve for removing said noncondensible gases from said refrigeration unit, said method comprising:

(a) storing data in said programmable controller representative of vapor pressure vs. temperature characteristics of said refrigerant in an uncontaminated state;

(b) reading in data for actual vapor pressure $P_i$ and temperature in an accumulator of said refrigeration unit;

(c) determining the pressure $P_s$ of uncontaminated refrigerant corresponding to the actual temperature in said accumulator from the data stored in step (a);

(d) calculating an error signal $P_i$–$P_s$;

(e) defining a minimum acceptable deviation for said error signal;

(f) determining when said error is greater than said minimum acceptable deviation;

(g) calculating a control output signal according to a proportional-integral-derivative (PID) control law for reducing said error; and (h) outputting said control signal so as to manipulate said control valve.

9. A method in accordance with claim 8 wherein said refrigerant is selected from a group of refrigerants including propane, freon-22, ammonia, freon-12, and methylchloride.

10. A method in accordance with claim 8 wherein said noncondensible gases comprise air and methane.

11. Apparatus for controlling a closed loop refrigeration unit having a purge system for removing noncondensable gases which contaminate the refrigerant in said closed loop refrigeration unit, said apparatus comprising:

means for essentially continuously determining the actual temperature and the actual vapor pressure of said contaminated refrigerant at a location in said closed loop refrigeration unit where said noncondensable gases tend to gather;

a programmable controller comprised of means for storing data representative of vapor pressure vs. temperature for an uncontaminated refrigerant, and wherein said programmable controller is further comprised of programming means programmed for:

i. essentially continuously determining the difference between the actual vapor pressure of said contaminated refrigerant and said stored data representative of the pressure of uncontaminated refrigerant at a corresponding temperature;

ii. calculating a control output signal needed to purge a volume of said contaminated refrigerant that is effective for reducing the difference between the actual vapor pressure of said contaminated refrigerant and said stored pressure data determined in step (i) to a desired value; and means for automatically purging said contaminated refrigerant from said closed loop refrigeration unit responsive to said control output signal when the actual vapor pressure exceeds the vapor pressure of uncontaminated refrigerant at the corresponding temperature by a predetermined amount.

12. Apparatus in accordance with claim 11 wherein said refrigerant is selected from a group of refrigerants including propane, freon-22, ammonia, freon-12 and methylchloride.

13. Apparatus in accordance with claim 11 wherein said noncondensible gases comprise air and methane.

14. Apparatus in accordance with claim 11 additionally comprising a pressure transducer operably located in the top of an accumulator in said refrigeration unit.

15. Apparatus in accordance with claim 14 wherein said means for comparing comprises:

means for establishing a first signal $P_i$ representative of the actual vapor pressure in said accumulator;

means for establishing a second signal representative of the actual temperature in said accumulator;

means for determining a value of the pressure stored in said programmable controller $P_s$ that corresponds to the temperature of said second signal;

means for establishing a third signal representative of the difference between $P_i$ and $P_s$.

16. Apparatus in accordance with claim 15 wherein a control valve is provided for said purge system and said means for automatically purging comprises:

means for establishing said control output signal responsive to said third signal; and means for providing said control signal to said control valve for said purging system.

* * * * *